United States Patent [19]

Narozny

[11] 4,009,921

[45] Mar. 1, 1977

[54] ELECTRICAL CONTACT AND SUPPORT MEANS THEREFOR

[75] Inventor: Ronald S. Narozny, Panorama City, Calif.

[73] Assignee: Thomas & Betts Corporation, Elizabeth, N.J.

[22] Filed: July 31, 1975

[21] Appl. No.: 600,825

[52] U.S. Cl. ..... 339/99 R; 339/125 R

[51] Int. Cl.[2] ..... H01R 9/08

[58] Field of Search ..... 339/17, 97–99, 339/125, 126, 176

[56] References Cited

UNITED STATES PATENTS

| | | | |
|---|---|---|---|
| 2,932,000 | 4/1960 | Buchanan | 339/125 R |
| 3,189,863 | 6/1965 | Leach | 339/99 R |
| 3,434,093 | 3/1969 | Wedekind | 339/99 R |
| 3,796,986 | 3/1974 | Tamburro | 339/176 MF |
| 3,874,762 | 4/1975 | Shott et al. | 339/99 R |

FOREIGN PATENTS OR APPLICATIONS

| | | | |
|---|---|---|---|
| 1,091,732 | 11/1967 | United Kingdom | 339/126 R |

*Primary Examiner*—Joseph H. McGlynn
*Attorney, Agent, or Firm*—David Teschner; Jesse Woldman

[57] ABSTRACT

An electrical contact adapted for resilient engagement with a substrate having a conductive surface thereon includes a highly deflective preferably spirally looped tail portion arranged to provide relatively uniform contact pressure over its elastic range of deflection. In one embodiment the tail portion is interconnected to a generally tubular head portion having cutting edges thereon for piercing through the insulation of an insulated conductor, a plurality of such electrical contacts being further designed to be contained within a connector housing adapted to interconnect a flat cable to a conductively surfaced substrate and including mounting means on the housing for maintaining the tail portions of the contacts in firm engagement with the substrate while minimizing the force required to assemble the connector to the substrate.

4 Claims, 14 Drawing Figures

ELECTRICAL CONTACT AND SUPPORT MEANS THEREFOR

BACKGROUND OF THE INVENTION

1. Field of the Invention

The invention is directed to the field of electrical connecting devices for engagement with conductively surfaced substrates or the like.

2. Description of the Prior Art

One of the major problems encountered in the field of electrical connectors adapted for assembly to a conductively surfaced substrate such as a printed circuit board or the like is the failure of many of such devices to adequately provide for varying board thicknesses since contact placement is generally fixed within the connector housing and the degree of deflection of the contact relatively limited. Accordingly, where the connector is mounted or otherwise secured to a board having a thickness greater than that for which the connector is designed, the contacts are caused to be deflected to a greater degree than contemplated thereby causing excessive pressure to be applied both to the contact and the conductive surface against which the contact is pressed. Additionally, the excessive pressure often results in undue wear of the conductive surface, leading to rapid deterioration of the electrical juncture between the contact and the conductive surface. Furthermore, many of such prior art devices are designed to be slidably engaged with the substrate, thereby aggravating the above noted condition while additionally requiring an excessive assembly force to mate the connector with the substrate.

SUMMARY OF THE INVENTION

The invention overcomes the difficulties and limitations noted above with respect to prior art devices by providing and electrical contact and support means therefor arranged to establish a relatively uniform, consistent, and reliable electrical connection to a substrate having a conductive surface thereon. The contact may be economically manufactured from flat metallic stock and comprises a preferably spirally formed looped tail portion interconnected by a web portion to a head portion arranged to be connected to a conductor. The tail portion is specifically designed to have a high degree of flexibility commensurate with a relatively uniform reactive force over the range of deflection. The head portion of the contact, in one embodiment, is of generally hollow tubular configuration terminating in a free end having one or more cutting edges for piercing through the insulation of an insulated conductor to provide engagement with the conductive portion thereof. A connector housing incorporating a plurality of such contacts is disclosed and comprises an elongate base member having a plurality of contact receiving slots, each of which further includes a tail receiving recess within which a major portion of the contact tail portion is located to restrict lateral movement of the tail portion while permitting the desired flexure thereof along the plane of the loop. Additional elements may be added to the base member to enclose the contacts therewithin and to provide means for supporting specially designed mounting clips arranged to permit the connector to be pivoted into position over the conductive surface of a substrate and to maintain proper pressure of the surface engaging segment of the contact tail portions against the adjacent surface. It is therefore an object of this invention to provide an improved electrical contact and support means therefor.

It is another object of this invention to provide an improved contact means for a printed circuit board connector or the like.

It is a further object of this invention to provide and electrical contact structure designed to apply a relatively uniform contact pressure against a mating surface over a wide range of deflection.

It is still another object of this invention to provide an improved flat cable connector.

It is yet another object of this invention to provide an electrical connector arranged to pivotingly mount to a substrate.

It is still a further object of this invention to reduce the wear associated with the assembly of a connector to a conductively surfaced substrate.

It is yet a further object of this invention to provide an electrical connector design adopted for assembly to conductively surfaced substrates of varying thicknesses.

It is still another object of this invention to provide, in combination, a pivotingly mountable connector and highly deflectable contact means for attachment to a conductively surfaced substrate.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 1:
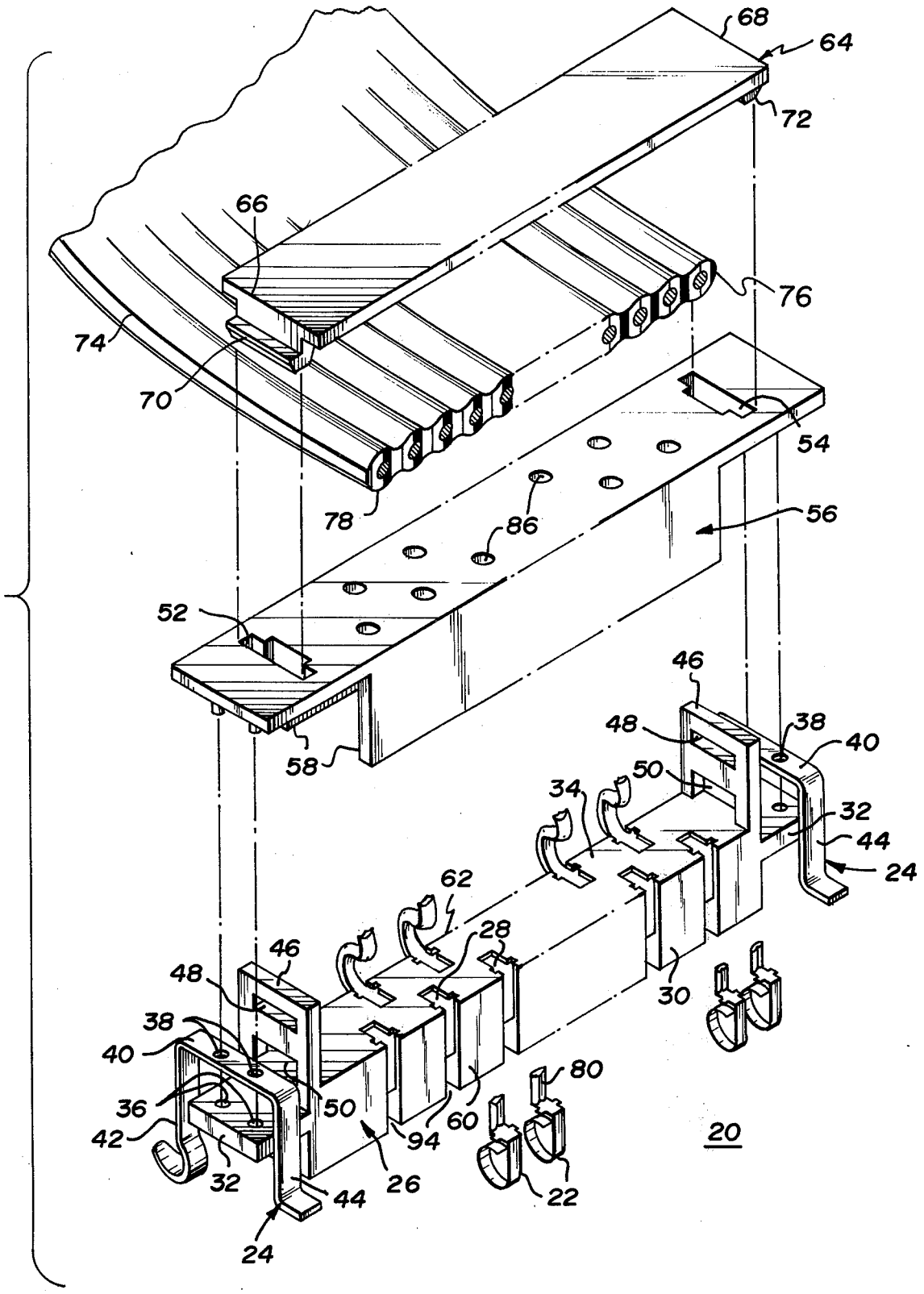
FIG. 1 is an exploded perspective view, partly cut away and partly in section, showing contact means and an embodiment of supporting structure therefor constructed in accordance with the concepts of the invention.
Figure 2:
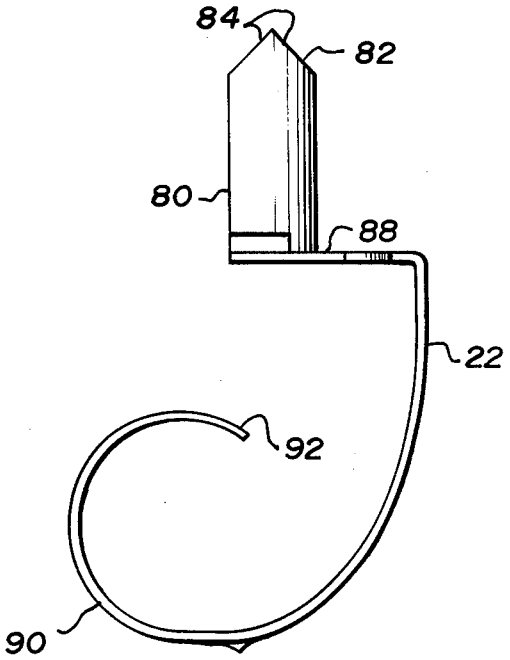
FIG. 2 is an enlarged side elevational view of the contact means of FIG. 1.
Figure 3:
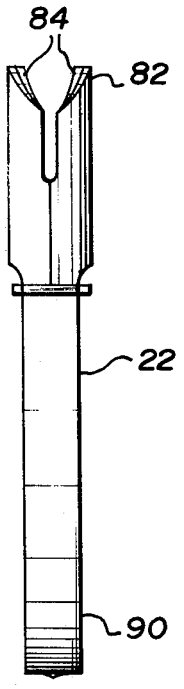
FIG. 3 is an enlarged front elevational view of the contact means of FIG. 1.
Figure 4:
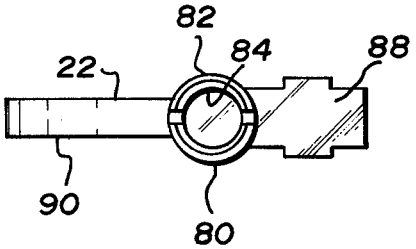
FIG. 4 is an enlarged top plan view of the contact means of FIG. 1.
Figure 5:
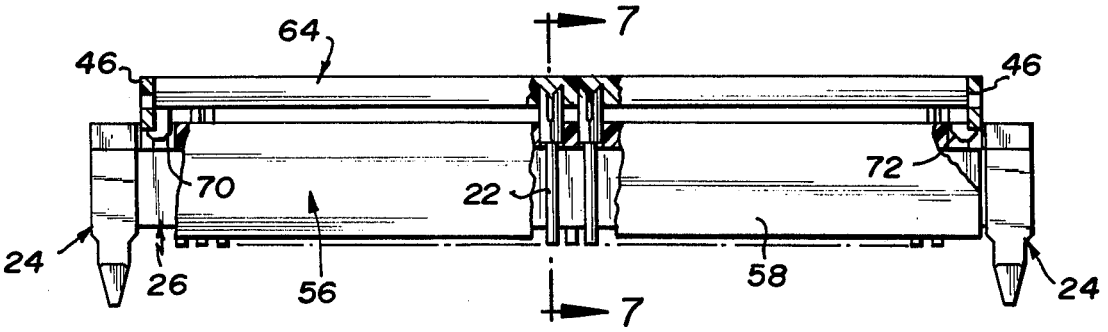
FIG. 5 is a front elevational view, partly in section and partly cut away, showing the parts of FIG. 1 fully assembled.
Figure 6:
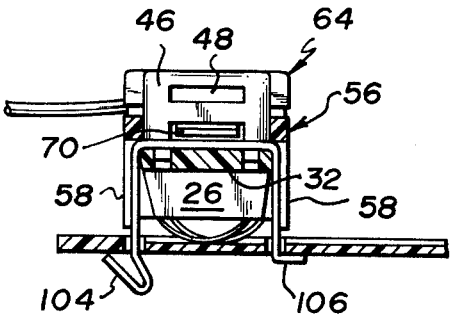
FIG. 6 is a side elevational view, partly in section, of the assembly of FIG. 5.
Figure 7:
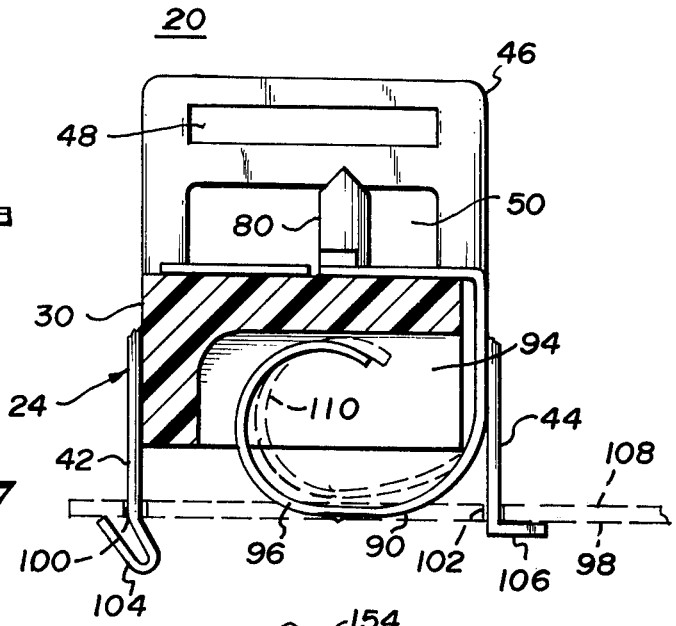
FIG. 7 is a sectional view taken along the line 7—7 of FIG. 5.
Figure 8:
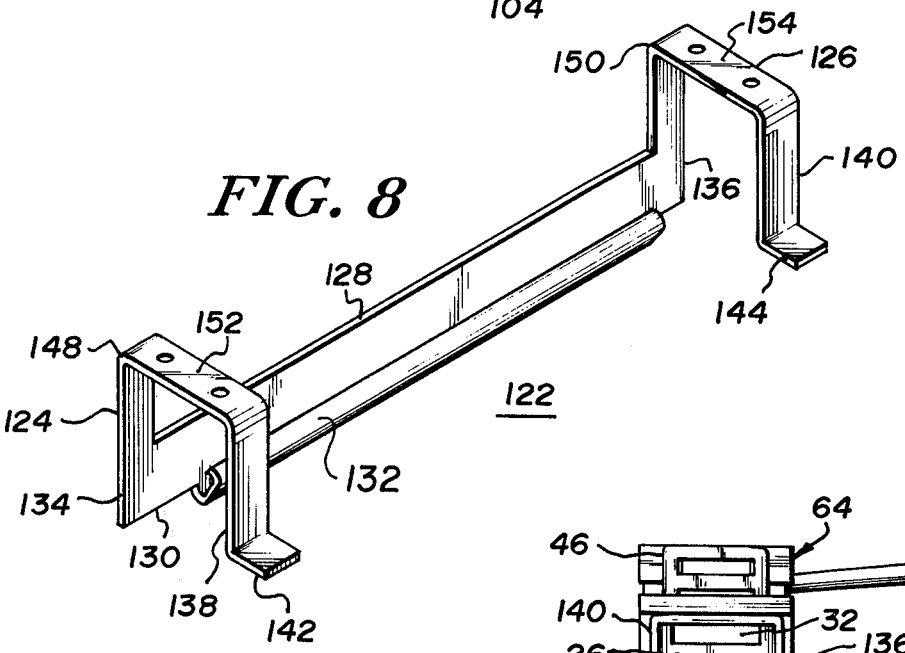
FIG. 8 is a perspective view of a further embodiment of a connector mounting means constructed in accordance with the concepts of the invention.
Figure 9:
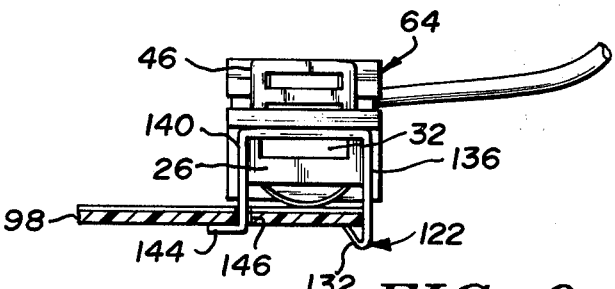
FIG. 9 is a side elevational view of an electrical connector employing the mounting means of FIG. 8.
Figure 14:
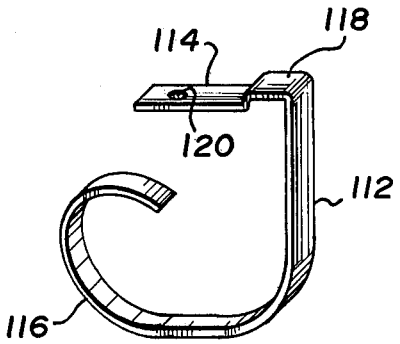
FIG. 14 is a perspective view of a further embodiment of a contact means constructed in accordance with the concepts of the invention.

Turning now to FIGS. 1, 2, 3, 4, 5, 6, and 7 there is shown an electrical connector 20 (FIG. 1) having contact means 22 and mounting means such as clips 24 constructed in accordance with the concepts of the invention. The connector includes a contact supporting base member 26 having transverse contact receiving slots 28 proportioned to receive the contact means 22, one of such contacts 22 being shown seated in its slot 28 at the lower left of FIG. 1. In the particular embodiment illustrated in FIG. 1, the base member 26 is constructed of dielectric material and comprises an elongate body portion 30 having a generally rectangular configuration in cross section. Extending longitudinally outwardly from each end of the body portion 30 is a shoulder 32 coplanar with the top surface 34 of body member 26 and arranged to provide a seat for the clip 24. Extending through the shoulder 32 are a pair of spaced transverse apertures 36 conforming generally to a pair of similarly spaced transverse apertures 38 in a bridge portion 40 joining the leg portions 42 and 44 of clip 24 so that the clips 24 may be attached to the respective shoulder portions 32 in a manner to be described hereafter. At the juncture between each of the shoulder portions 32 and the top surface 34 of the body member 30 there is provided an upstanding leg 46 having an upper slot 48 and a lower slot 50 extending transversely therethrough. The legs 46 are arranged to be received through a pair of suitably configured spaced slots 52 and 54 in a cover member 56 adapted to overlie the base member 26. The cover member 56 is also formed of a dielectric material and includes a pair of opposingly disposed downturned skirt portions 58 extending longitudinally along opposite edges of the cover member 56, the interior facing surfaces of the skirt portions 58 being spaced from one another a distance generally equal to the width of the body member 30 as defined by its side surfaces 60 and 62. Overlying the cover member 56 is a cap member 64 arranged to lock the cover member 56 to the base member 26. The cap member 64 is formed preferably of a dielectric material which may be similar to the material used to construct the base and cover members 26 and 56, respectively, and is shown as having a generally plane rectangular configuration. The short ends 66 and 68 of the cap member 64 are each provided with a normally extending latch means 70 and 72, respectively, arranged to releasable engage a respective lower slot 50 of the base member arms 46. The arms 46 are designed so that as the cover member 56 is seated firmly over the base member 26, the arms 46 will extend through the apertures 52 in the cover member 56 sufficiently to expose a sufficient portion of the lower slots 50 above the top surface of the cover member 56 to enable each of the latch means 70 and 72 to enter and engage a respective one of the slots 50. The engagement between the cap member latch means 70 and 72 and the slots 50 in the arms 46 is accomplished by applying a downward pressure against the cap member 64 causing the latch means 70 and 72 to contact and deflect the arms 46 outwardly sufficiently to permit further movement of each of the latch means 70 and 72 against the inwardly facing surface of a respective arm until each latch means is aligned with and engages a respective slot 50 substantially as shown in FIGS. 5 and 6. The particular embodiment illustrated in FIG. 1 is arranged to receive a flat conductive cable such as 74 comprising a series of spaced parallel conductive elements 76 embedded in or laminated between the layers of a flexible dielectric material 78. To pierce through the insulative material 78 of cable 74, the contact means 22 which may be economically manufactured from a flat strip of metallic stock comprises a head portion 80 of generally tubular configuration and terminating in a free end 82 having cutting edges 84 thereon for piercing through the insulation of an insulated conductor. A specific arrangement of the head portion 80 which has been found particularly useful in such applications is disclosed in greater detail in my copending application Ser. No. 499,588 filed Aug. 22, 1974 and assigned to the assignee of the instant invention. The cover member 56 is provided with a series of transverse apertures 86 selectively arranged both in size and spacing to accept the head portions 80 of the contact means 22 therethrough. Accordingly, after the cover member 56 is placed over the base member 26, the upper or free ends 82 of the contact means are exposed above the top surface of the cover member 56. The cable 74 may then be positioned over the cover member 56 and aligned therewith so that each of the conductors 76 overlies a respective contact means head portion 80. The cap member 64 is then placed over the cable 74 and aligned with the cover member 56 so that the latch means 70 and 72 directly abut a respective one of the arm portions 46. The cap member 64 may then be employed as an anvil by applying pressure thereto in a downwardly direction towards the cover member 56 to uniformly urge the cable 74 against the sharpened cutting edges 84 of the contact means head portions 80. Sufficient pressure is applied to cause the cutting edges 84 to penetrate the outer insulation of the cable 74 and contact the respective conductors 76. The latch means 70 and 72 are designed so that, upon full engagement between the cutting edges 84 of the contact means 22 and the respective cable conductors 76, the latch means will enter and lock within the respective slots 50 in the arms 46 of the base member 26 substantially as shown in FIG. 5. The upper slots 48 in the arms 46 permit the cap member 64 to be preassembled to the arms 46 by engagement of the latch means 70 and 72 therewithin. This arrangement provides an additional convenience in shipping and handling whereby all of the parts of the connector 20 may be loosely held together as a unit prior to the assembly of the connector 20 to the cable 74. Furthermore, such arrangement provides a useful means for guiding and aligning the end portion of the cable 74 within the gap between the undersurface of the cap member 64 and the exposed end of the contact means head portions 80 preparatory to completing the connection to the cable 74. It should be understood that the pre-assembled arrangement may be employed where access to the end portion is readily available. Where, however, the connector 20 is to be assembled to the cable 74 at a selected position intermediate its ends, and where both ends of the cable 74 have been previously terminated or other wise encumbered so as to prevent insertion of the cable 74 through the gap between the cap portion 68 and the cover portion 56, the cap member 64 may be readily removed from its pre-assembled interengagement with the arms 46 of the cover member 56 to permit mid-span engagement of the cable 74. Referring now more specifically to FIGS. 2, 3, and 4, the contact means 22 further comprises a web portion 88 connecting the head portion 80 to a looped tail portion 90 having preferably a generally spiral configuration and terminating in and end portion 92 curling inwardly beneath the head portion 80. The spiral tail configuration has the unique characteristic of permitting the tail portion 90 to undergo a relatively large deflection without permanent deformation or set while providing a relatively uniform reactive force throughout the deflection range. Although almost any particular spiral configuration may be employed, a generally logarithmic spiral has been found to be particularly effective in providing the aforementioned characteristics. The base member body portion 30 is constructed so as to provide a series of tail receiving recesses 94 (FIG. 1) located along the underside of the body member 30 and communicating with the respective contact receiving slots 28. As shown in greater detail in FIG. 7, the contact means tail portion 90 is partially encompassed within its respective recess 94, there being an exposed surface engaging segment 96 lying beyond the confines of the recess 94 for engagement with a conductively surfaced substrate 98 shown in dotted outline in FIG. 7. As further illustrated in FIG. 7, the substrate 98 is suitably apertured to provide two pair of spaced apertures 100 and 102 (only one of such pair being visible in FIG. 7), each arranged to receive a respective one of the leg portions 42 and 44 of the clips 24 therein. As further illustrated in detail in FIG. 7, the leg portion 42 terminates in an outwardly directed hook portion 104 while the leg portion 44 terminates in an offset foot portion 106. This arrangement permits the connector 20 to be pivotingly mounted to the substrate 98 by first inserting the offset foot portions 106 of each clip 24 into a respective aperture 102 and then pivoting the connector 20 thereabout and towards the substrate 98, forcing the hook portions 104 of each clip 24 against and through a respective aperture 100 in the substrate 98. The tail portions 90 of the series of contact means 22 are thus caused to contact the adjacent surface 108 of the substrate 98 and be deflected upwardly within their respective recesses 94 to the position shown generally by the dotted outline 110. It will, of course, be understood that the length of the leg portions 42 and 44 of the clips 24 are chosen so as to insure that the surface engaging segments 96 of the tail portions 90 will firmly contact the substrate 98 in the assembled state. It should also be noted that, due to the unique deflection characteristics of the spiral configuration of the contact means tail portions 90, the thickness of the substrate 98 to which the connector 20 is attached may vary within relatively wide limits without adversely affecting the degree and reliability of the connection between the contact means tail portion 90 and the adjacent surface 108 of the substrate 98. By pivoting the connector 20 into position as described above, the wear generally resulting from the use of prior art devices in which the connector is slidably joined to the substrate is completely avoided. Although the particular embodiment 20 of the contact means of the instant invention is shown as including an insulation piercing head portion, a contact means such as 112 shown in FIG. 14 may be readily substituted therefor, where necessary or desirable. In this case, there is provided a head portion 114 of tab-like construction which is joined to a tail portion 116 having a looped configuration essentially duplicative of portion 90 of the contact means 22 by a web portion 118 offset from the plane of the head portion 114. The head portion 114 is arranged to receive the bared or stripped portion of an insulated conductor preferably by soldering or the like and may further include a transverse aperture 120 for mechanically joining the conductor to the head portion 114. It will also be readily apparent to those skilled in the art that other head portion configurations particularly suited for crimping or the like may be substituted for those described above without departing from the spirit of the invention and within the concepts herein disclosed. It will also be appreciated that the clip means 24 serve an important function in the assembly and retention of the connector 20 to a substrate such as 98 in providing a means for avoiding the sliding assembly operation generally associated with prior art devices. However, to permit the assembly of the connector 20 to the edge of a substrate such as 98 there may be provided a clip means 122 as shown in FIG. 8 comprising a pair of spaced U-shaped elements 124 and 126 joined together by a bridge portion 128 having a lower edge 130 terminating in a lip portion 132. Each of the U-shaped elements 124 and 126 includes a rear leg portion 134, 136, respectively, and a front leg portion 138, 140, respectively. The bridge portion 132 extends between the rear leg portions 134 and 136 to provide structural unity therebetween. The front leg portions 138 and 140 each terminate in an offset foot portion 142, 144, respectively, essentially duplicative of the portions 106 of clips 24. The U-shaped elements 124 and 126 are assembled to the shoulders 32 of the connector body portion 30 in the same manner as described above with respect to the clip means 24. However, in this case, the bridge portion 128 is disposed against the side of the connector body portion 30 and is at least partially supported thereby resulting in an assembly substantially as shown in FIG. 9. To mount the connector 20 to the substrate 98, the offset foot portions 142 and 144 of the front leg portions 138 and 140, respectively, of the clip means 122 are first inserted into a pair of suitably located corresponding apertures in the substrate 98, only one of which is visible and identified by the numeral 146 in FIG. 9. The connector 20 is then pivoted downwardly towards the surface of the substrate 98, causing the lip portion 132 of the clip means 122 to contact the adjacent edge of the substrate 98. The clip means 122 is formed of resilient material having sufficient flexibility so that rear leg portions 134 and 136 and the bridge portion 128 may flex outwardly as a unit about a fulcrum located generally at the junctures 148 and 150 between the rear leg portions 134 and 136, respectively, and the interconnecting portions 152 and 154 joining the rear leg portions 134 and 136 to the front leg portions 138 and 140 of the U-shaped elements 124 and 126. Accordingly, as further pressure is applied to the connector 20, the lip portion 132 of clip means 122 is caused to deflect outwardly and return beneath the edge of the substrate 98 and come to rest in a position substantially as shown in FIG. 9.

Figure 10:
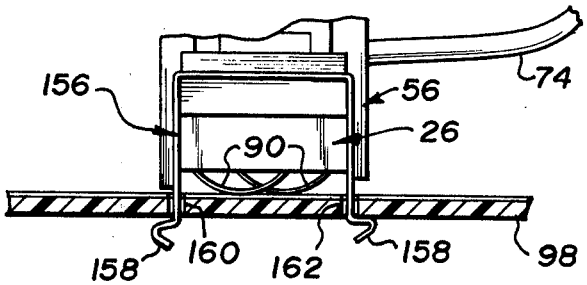
FIG. 10 is a fragmentary side elevational view showing a further embodiment of a connector mounting means constructed in accordance with the concepts of the invention.
Figure 11:
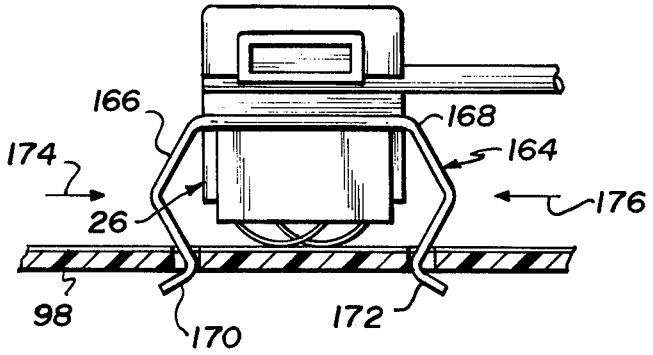
FIG. 11 is a side elevational view of yet another embodiment of a connector mounting means constructed in accordance with the concepts of the invention.

Turning now to FIG. 10 there is shown an alternative embodiment of a U-shaped clip means 156 constructed in accordance with the concepts of the invention. In this embodiment, each of the leg portions of the clip means 156 is provided with a foot portion 158 of similar configuration in the form generally of a reversely bent hook the bights of which extend away from one another and arranged to contact the edge of suitably spaced mounting apertures 160 and 162 in the substrate 98 and be deflected inwardly sufficiently to permit the foot portions 158 to pass through the apertures 160 and 162 and engage the underside of the substrate 98, substantially as shown. A further alternative embodiment of a clip means 164 is shown in FIG. 11, and comprises a generally U-shaped element having bowed front and rear leg portions 166 and 168, respectively, of generally V-shaped contour extending, firstly, slightly away from the adjacent sides of the base member 26, and then returning inwardly and terminating in outwardly directed foot portions 170 and 172, respectively. The leg portions 166 and 168 are preformed to have a spacing in the relaxed position therebetween slightly greater than the spacing between the mounting apertures in the substrate 98. Accordingly, by applying pressure to the clip means leg portions 166 and 168 in the direction shown generally by the arrows 174 and 176, respectively, the foot portions 170 and 172 are aligned with the receiving apertures and are forced therethrough. The pressure is then removed and the leg portions 166 and 168 tend to return to their initial state causing the foot portions 170 and 172, respectively, to lock within the receiving apertures, substantially as shown.

Figure 12:
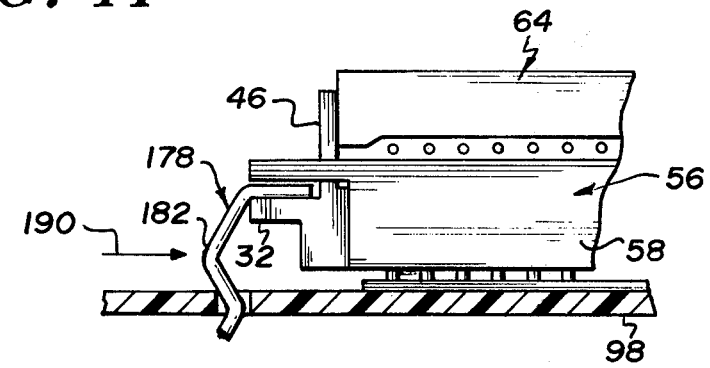
FIG. 12 is a fragmentary front elevational view, showing still another embodiment of a connector mounting means constructed in accordance with the concepts of the invention.
Figure 13:
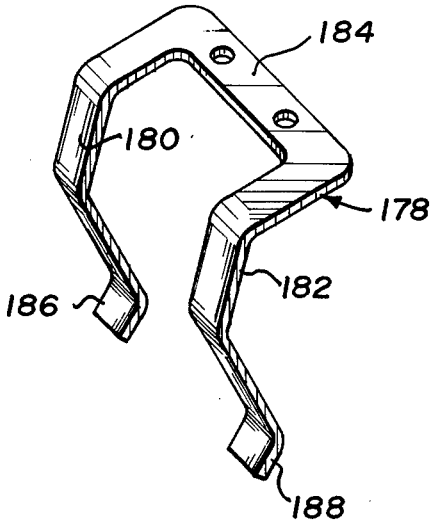
FIG. 13 is an enlarged perspective view of the mounting means of FIG. 12.

Turning now to FIGS. 12 and 13, there is shown still another embodiment of a clip means 178 constructed in accordance with the concepts of the invention. Clip means 178 is constructed to have a generally U-shaped configuration including a pair of leg portions 180 and 182 of generally V-shaped contour, but differing from the leg portions 166 and 168 of clip means 164 in being disposed generally at right angles to a portion 184 interconnecting the leg portions 180 and 182 to one another. The clip means 178 is mounted to the connector base member 26 essentially as shown in FIG. 12 so that the leg portions 180 and 182 extend away from the ends of the base member 26 rather than from the sides thereof as in the embodiment illustrated in FIG. 11. In the fragmentary view shown in FIG. 12, only one end of the base member 26 is visible. However, it should be understood that the clip means 178 is mounted to both ends of the base member 26 in a similar manner and that all reference to the clip means 178 and the manner of operation thereof applies equally to the other end of the base member 26. As further illustrated, each of the leg portions 180 and 182 terminates in a foot portion 186, 188, respectively, duplicative of the foot portions 170 and 172 shown in FIG. 11. However, in the arrangement shown in FIG. 12, the connector 20 is mounted to the substrate 98 by applying a pressure to the leg portions 180 and 182 in the direction shown by the arrow 190 to align the foot portions 186 and 188 with suitably spaced and configured mounting apertures in the substrate 98. The remaining steps in the mounting procedure are essentially as described heretofore with respect to the embodiment illustrated in FIG. 11 and therefore need not be repeated. It may be noted, however, that whereas the arrangement shown in FIG. 11 requires either a two-handed or two-step operation to effect the mounting of the connector 20, the arrangement shown in FIG. 12 permits a single-handed operation wherein the thumb and forefinger of one hand of the user may be employed to compress both clip means 178 simulataneously. It should also be appreciated that the bowed configuration of the leg portions of the clip means 164 and 178 provide an additional degree of flexibility thereat permitting further compensation for variations in substrate thickness and contact tail portion configuration.

The embodiments of the invention in which an exclusive property or privilege is claimed are defined as follows:

1. An electrical connector comprising, in combination: a base member having an elongate body portion, a first end portion and a second end portion, said first and second end portions being located at opposite ends of said body portion, said body portion having a plurality of transverse contact receiving slots therein extending along the length of said body portion, a plurality of contacts, one for each of said contact receiving slots and seated therewithin, said contacts each having a head portion, a tail portion, and a web portion joining said head portion to said tail portion, said head portion and said tail portion extending from opposite surfaces of said body portion, said tail portion having a generally flat spiral configuration, a segment of said tail portion furthermost from said head portion extending outwardly from said body portion for engagement with a conductive surface, said contact receiving slots each having a selectively dimensioned tail receiving cavity having sidewalls and a bottom surface and communicating therewith, said tail portion of each of said contacts being partially contained within a respective one of said tail receiving cavities and deflectably movable from a first position wherein the free end of said tail portion is spaced from said bottom surface to a second position wherein the free end of said tail portion is caused to contact said bottom surface; means for securing said contacts in position in said body portion; and means for mounting said connector adjacent a conductive surface; said mounting means comprising a pair of generally U-shaped resilient metallic members each attached to a respective one of said first and said second end portions of said base member, each of said U-shaped members comprising a pair of leg portions joined to one another by a first bridge portion attached to a respective one of said first and said second end portions of said body portion, at least one of said leg portions terminating in an outwardly facing foot portion arranged to extend through a transverse aperture in and engage the underside of a planar part upon which said connector is mounted.

2. An electrical connector as defined in claim 1 wherein the unjoined leg portions of said U-shaped members each terminate in an offset foot portion.

3. An electrical connector as defined in claim 1 further comprising a second bridge portion joining only a single leg portion of each of said U-shaped members to one another.

4. An electrical connector as defined in claim 3 wherein said second bridge portion includes a bottom edge terminating in a turned up lip portion for engagement with a given edge of a planar part upon which said connector is mounted.

* * * * *